United States Patent [19]

Wong et al.

[11] Patent Number: 5,038,152

[45] Date of Patent: Aug. 6, 1991

[54] BROAD BAND OMNIDIRECTIONAL MONOCONE ANTENNA

[75] Inventors: Mon N. Wong, Torrance; Samuel S. Wong, Lawndale; Gregory D. Kroupa, Hawthorne; Robert C. Perpall, Manhattan Beach, all of Calif.

[73] Assignee: Hughes Aircraft Company, Los Angeles, Calif.

[21] Appl. No.: 524,602

[22] Filed: May 17, 1990

[51] Int. Cl.[5] ..... H01Q 13/02; H01Q 19/22

[52] U.S. Cl. ..... 343/756; 343/772; 343/785; 343/833; 343/834

[58] Field of Search ..... 343/756, 772–775, 343/785, 786, 790, 833, 834, 846

[56] References Cited

U.S. PATENT DOCUMENTS

| | | | |
|---|---|---|---|
| 2,588,610 | 3/1952 | Boothroyd et al. | 343/833 |
| 2,645,769 | 7/1953 | Roberts | 343/786 |
| 3,087,157 | 4/1963 | Bogner | 343/785 |
| 4,274,097 | 6/1981 | Krall et al. | 343/785 |

FOREIGN PATENT DOCUMENTS

| | | | |
|---|---|---|---|
| 2648375 | 4/1978 | Fed. Rep. of Germany | 343/785 |
| 518194 | 3/1955 | Italy | 343/785 |

*Primary Examiner*—Michael C. Wimer

*Attorney, Agent, or Firm*—Robert A. Westerlund; Steven M. Mitchell; Wanda K. Denson-Low

[57] ABSTRACT

A broad band omnidirectional monocone antenna 10 having a wide operative frequency spectrum and a large elevation angle A is disclosed herein. The antenna 10 of the present invention includes an input circular waveguide network 12 and 18 for providing electromagnetic energy of at least one polarization. Coupled to the circular waveguide network 12 and 18 is a dielectric-loaded waveguide arrangement 22 for projecting a first electromagnetic beam. The inventive antenna 10 further includes a parasitic element network 32, 34, and 36 positioned in the path of the first beam. The parasitic element network 32, 34, and 36 is disposed to form a parasitic beam in response to the first beam. In a particular embodiment of the inventive antenna 10 a beam shaping cone 40 circumscribes the dielectric waveguide arrangement 22. The cone 40 is adapted to augment the elevation angle A characterizing the antenna 10 of the present invention by redirecting the parasitic beam.

10 Claims, 3 Drawing Sheets

FIG. 2
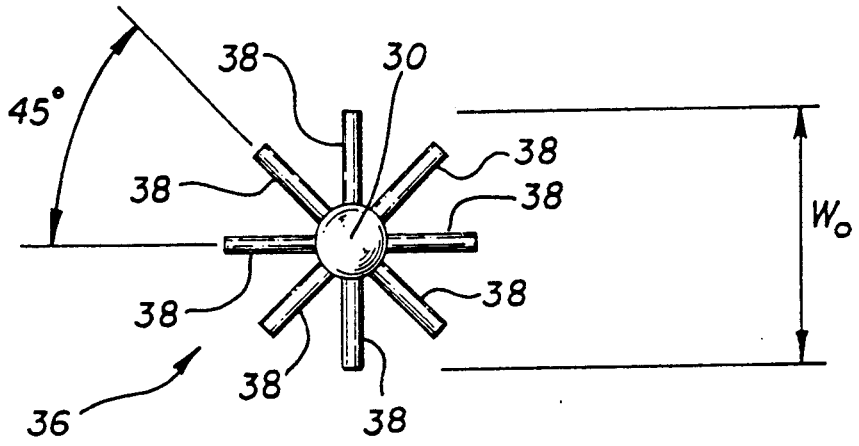
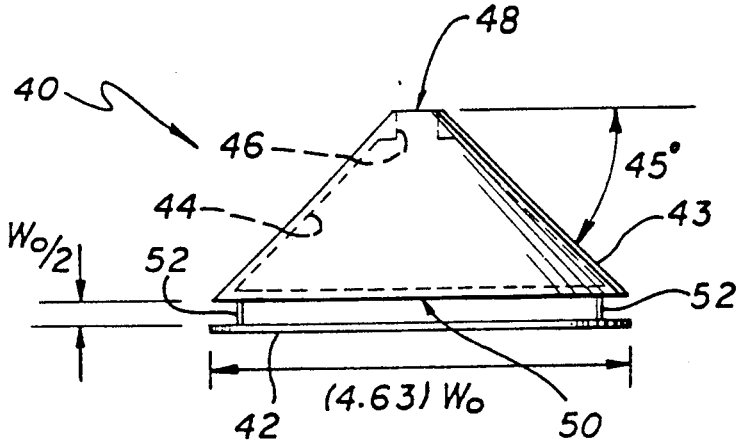
FIG. 3a
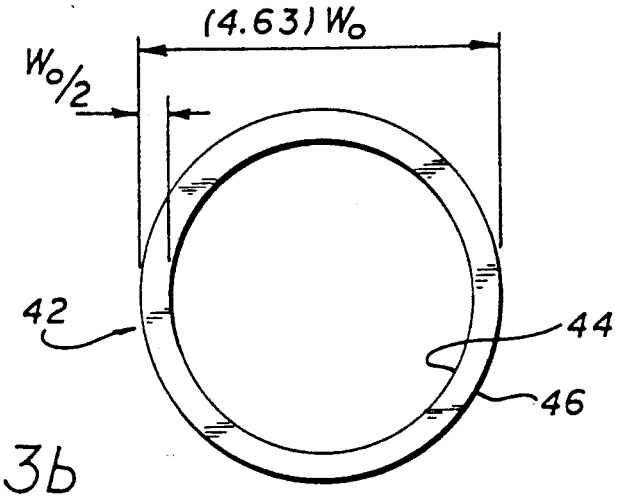
FIG. 3b

BROAD BAND OMNIDIRECTIONAL MONOCONE ANTENNA

BACKGROUND OF THE INVENTION

1. Field of the Invention

This invention relates to antennas. More specifically, this invention relates to dielectric rod antennas.

While the present invention is described herein with reference to a particular embodiment, it is understood that the invention is not limited thereto. Those having ordinary skill in the art and access to the teachings provided herein will recognize additional embodiments within the scope thereof.

2. Description of the Related Art

Many satellites include a "telemetry and command" antenna system for facilitating communication with an earth station. Such antenna systems often include two cones and project a beam having a longitudinal axis coincident with that of the satellite. Spin stabilized satellites are stabilized by rotating about their longitudinal axes. Accordingly, telemetry and command antennas are generally omnidirectional. Omnidirectional antennas are disposed to receive signals from any direction provided such signals are within the field of view of the antenna. The field of view of the antenna is quantified by reference to its "elevation angle"—the angle subtended by the projected antenna beam relative to the longitudinal axis. Conventional dual cone antenna systems are typically characterized by an elevation angle of less than ±90 degrees. The breadth of the elevation angle of a satellite's telemetry and command antenna influences the permissible range of orientations the satellite may assume relative to the earth without impairing communication therewith. Accordingly, a need in the art exists for an antenna adapted for telemetry and command communication which has an elevation angle in excess of ±90 degrees.

Existing satellite telemetry and command antennas also have relatively narrow bandwidths. In particular, the spectrum of frequencies conventionally available for communication is generally equivalent to two percent of the center frequency of the antenna. This narrow bandwidth generally necessitates the deployment of separate antennas for transmit and receive channels in order to avoid interference therebetween.

It follows that a need in the art exists for a satellite antenna having a bandwidth sufficient to simultaneously accommodate transmit and receive channels while maintaining adequate interchannel isolation.

SUMMARY OF THE INVENTION

The need in the art for a satellite telemetry antenna having a wide operative frequency spectrum and a large elevation angle is addressed by the broad band omnidirectional monocone antenna of the present invention. The inventive antenna includes an input circular waveguide network for providing electromagnetic energy of at least one polarization. Coupled to the circular waveguide network is a dielectric-loaded waveguide arrangement for projecting a first electromagnetic beam. The antenna of the present invention further includes a parasitic element network positioned in the path of the first beam. The parasitic element network is disposed to form a parasitic beam in response to the first beam. In a particular embodiment of the inventive antenna a beam shaping cone circumscribes the dielectric waveguide arrangement. The cone is adapted to augment the elevation angle characterizing the antenna of the present invention by redirecting the parasitic beam.

BRIEF DESCRIPTION OF THE DRAWINGS

FIG. 2 shows a top view of a conductive cylindrical supporting mast with a third set of parasitic elements coupled thereto.

FIG. 3*a* is a magnified side view of a beam shaping cone and associated cone choke.

FIG. 3*b* shows a top view of the cone choke.

DETAILED DESCRIPTION OF THE INVENTION

Figure 1:
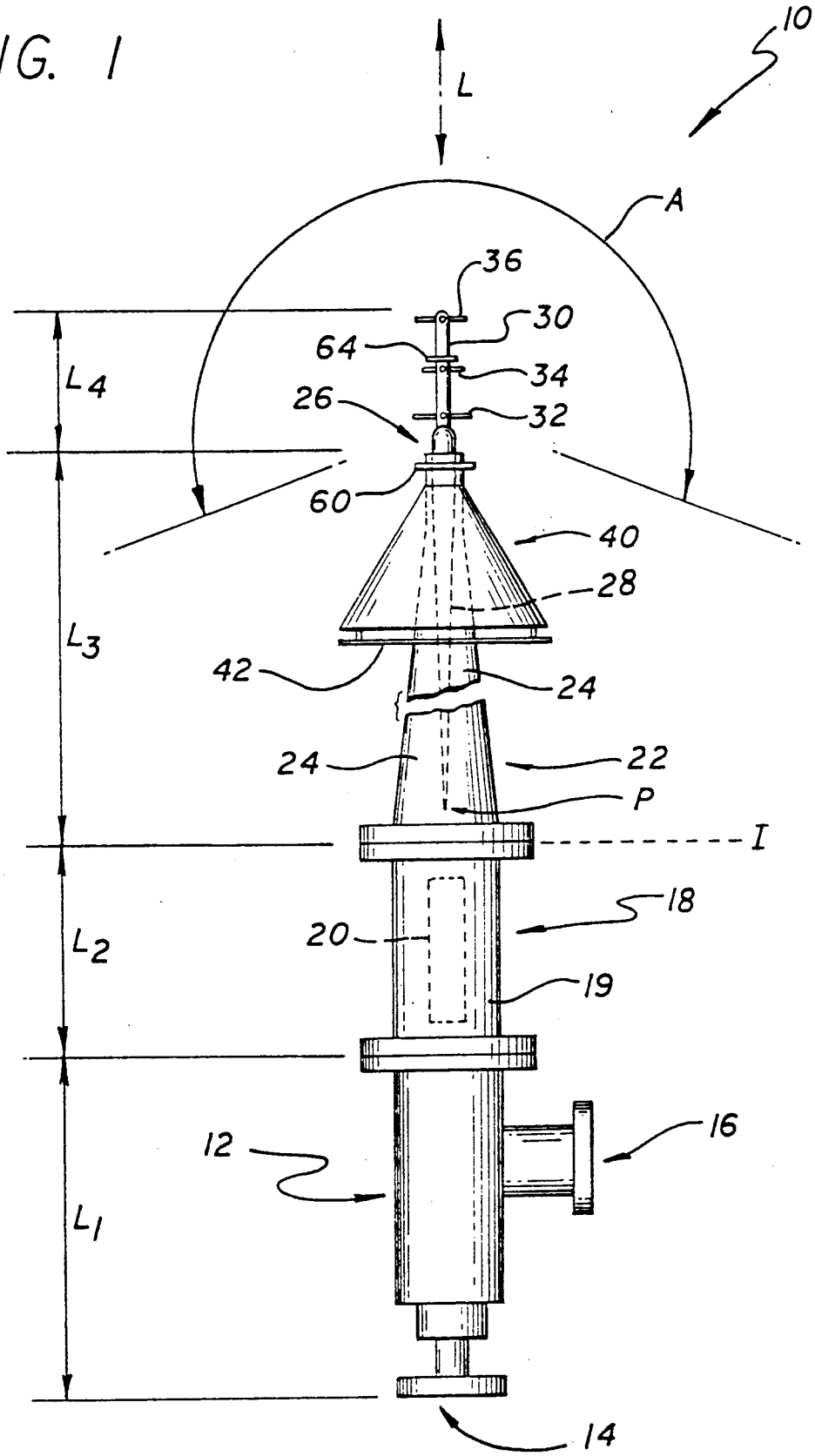
FIG. 1 is a side view of the broad band omnidirectional monocone antenna of the present invention.

FIG. 1 is a side view of the broad band omnidirectional monocone antenna 10 of the present invention. As will be described more fully below, the antenna 10 is operative to transmit and receive signals by projecting a radiation pattern subtending an elevation angle A. As shown in FIG. 1, the elevation angle A spans approximately ±110 degrees relative to a longitudinal axis L of the antenna 10. As mentioned in the Background of the Invention, the elevation angle of conventional satellite telemetry and command antennas is generally limited to less than ±90 degrees. Moreover, in the embodiment of FIG. 1 the antenna 10 is disposed to operate over the frequency spectrum extending from approximately 11.8 to 14.8 GHz. This corresponds to a frequency bandwidth of approximately twenty two percent, which is substantially larger than that generally exhibited by conventional satellite telemetry and command antennas. The broad bandwidth of the antenna 10 enables the coexistence of distinct channels for contemporaneous operation in a transmit and a receive mode, thereby obviating the need for separate transmit and receive antennas. Although the following discussion will proceed assuming operation in the transmit mode, those skilled in the art will appreciate the reciprocal operation of the present invention in the receive mode.

The antenna 10 is in communication with a waveguide feed network (not shown) through an orthomode tee 12. The tee 12 includes a waveguide channel of circular cross-section and is composed of conductive material. As shown in FIG. 1, the tee 12 has a longitudinal dimension of L1. The length L1 may be chosen to be equivalent to $3.12W_o$, where $W_o$ is the free space wavelength corresponding to a design frequency within the aforementioned operative frequency spectrum of the antenna 10. The tee 12 includes first and second waveguide feed ports 14 and 16 coupled to the feed network. The first and second ports 14 and 16 are designed to accept electromagnetic energy of first and second linear polarizations from the feed network and may be excited either individually or contemporaneously. The first and second polarizations are separated by a polarization angle of 90 degrees—thereby making the energy entering the ports 14 and 16 orthogonally polarized. The diameter d1 of the orthomode tee 12 in the present embodiment is $0.64W_o$, thus supporting a dominant $TE_{11}$ mode.

The orthomode tee 12 is mechanically coupled by a conventional screw arrangement to a 90 degree dielectric polarizer 18. The polarizer 18 includes an outer conductive cylindrical shell 19 which defines a waveguide channel having a circular cross-section of diameter d1. As shown in phantom in FIG. 1, dielectric material 20 is inserted within the waveguide channel of the polarizer 18. In the preferred embodiment, the dielectric material 20 has a relative dielectric constant K of approximately 3.1 and may be realized from a variety of materials including fiberglass. In addition, the length L2 of the polarizer 18 is substantially equivalent to $2.31W_o$. The polarizer 18 is operative to transform the first and second polarizations of the energy entering the ports 14 and 16 into first and second rotating linear polarizations. In particular, the polarizer 18 induces rotation of the first polarization in a first direction and rotation of the second polarization in the opposite direction. In this manner the polarizer 18 sets up a rotational $TE_{11}$ mode therein.

Again, the polarizer 18 is mechanically coupled by a conventional screw arrangement to a dielectric-loaded tapered circular waveguide 22 of a length L3 substantially equivalent to $7.87W_o$. The tapered waveguide 22 includes a conductive outer shell 24 which defines a waveguide channel of circular cross section. The diameter of the waveguide channel decreases from an initial value of d1 ($0.64W_o$) at the interface I of the polarizer 18 and waveguide 22, to an aperture diameter d2 of $0.32W_o$ at an aperture 26 defined by the tapered waveguide 22. As shown in phantom in FIG. 1, a tapered dielectric rod 28 is inserted within the tapered waveguide channel. The diameter of the rod 28 decreases from approximately $0.32W_o$ at the aperture 26, to a point P relatively near the interface I. The rod 28 contacts the waveguide channel defined by the tapered waveguide 22 at the aperture 26 and is thereby mechanically held in position. A tapered ULTEM-1000 (K=3.1) dielectric rod manufactured by General Electric may be utilized for the rod 28.

The presence of the dielectric rod 28 within the tapered waveguide 22 reduces the cutoff frequency thereof. As a consequence, energy propagating between the polarizer 18 and the waveguide 22 experiences a lower reflection coefficient. In this manner, the tapered waveguide 22 enhances the efficiency by which polarized energy from the polarizer 18 propagates through the aperture 26 to excite a radiation pattern. Moreover, inclusion of the dielectric rod 28 within the tapered waveguide 22 extends the operative bandwidth of the antenna 10. By providing a relatively wide operative frequency band (11.8 to 14.8 GHz in the embodiment of FIG. 1), the antenna 10 is disposed to simultaneously function in a transmit and receive mode. Specifically, a pair of distinct frequency spectra within the operative band may be designated transmit and receive channels—thereby obviating the need for separate antenna systems for signal transmission and reception.

As shown in FIG. 1, the dielectric rod 28 protrudes through the aperture 26 and supports a cylindrical conductive mast 30 approximately 0.25 inches in diameter. The mast 30 is partially embedded in the dielectric rod 28 and extends therein a distance sufficient to insure adequate mechanical stabilization. The exposed portion of the dielectric rod 28 and the mast 30 extend a distance L4 of approximately $1.67W_o$ from the waveguide aperture 26. The mast 30 supports first, second and third sets of parasitic elements 32, 34, and 36.

FIG. 2 shows a top view of the mast 30 with the third set of parasitic elements 36 coupled thereto. The third set of parasitic elements 36 includes eight individual conductive parasitic elements 38. Each element 38 is cylindrically shaped and, in the illustrative embodiment, has a cross-sectional diameter of approximately 0.030 inches. As shown in FIG. 2, the third set of parasitic elements 36 describes a circle of diameter $W_o$. The third set of parasitic elements 36 has a resonant frequency near the center of the operative frequency spectrum, while the first and second element sets 32 and 34 have respective resonant frequencies near the low and high regions thereof. The first and second sets of parasitic elements 32 and 34 are substantially similar to the third set of parasitic elements 36, with the exception that the circles described by each have respective diameters greater and less than $W_o$.

As shown in FIG. 1, the antenna 10 further includes a forty-five degree beam shaping cone 40 and cone choke 42. The beam shaping cone 40 and cone choke 42 may both be realized from conductive materials and are depicted in greater detail in the magnified side view of FIG. 3*a*.

As shown in FIG. 3*a*, the cone 40 includes an outer surface 43 tapered at an angle of forty-five degrees with respect to the horizontal plane occupied by the choke 42 and an inner tapered surface 44. The cone 40 also includes an inner cylindrical surface 46 which defines a first cone aperture 48. The inner tapered surface 44 defines a second cone aperture 50. The cone choke 42 is disk-shaped and coupled to the cone 40 by conductive supports 52 spaced symmetrically about the second aperture 50. The supports 52 suspend the cone choke 42 approximately $W_o/2$. from the cone 40. The outer diameter ($4.63W_o$) of the cone choke 42 is equivalent to the distance between opposite points on the outer surface 43 of the cone 40 at the aperture 50.

FIG. 3*b* shows a top view of the cone choke 42. As shown in FIG. 3*b* the inner surface 44 of the cone choke is separated from the outer surface 46 thereof by a distance of $W_o/2$. As shown in FIG. 1, the cone 40 is mechanically secured to the waveguide 22 in a conventional manner by affixing the inner cylindrical cone surface 46 to the conductive waveguide shell 24.

The effect of the first, second and third sets of parasitic elements 32, 34, 36 and the beam shaping cone 40 on the radiation pattern emitted by the antenna 10 will be described with reference to FIGS. 4*a*, 4*b*, and 4*c*.

Figure 4C:
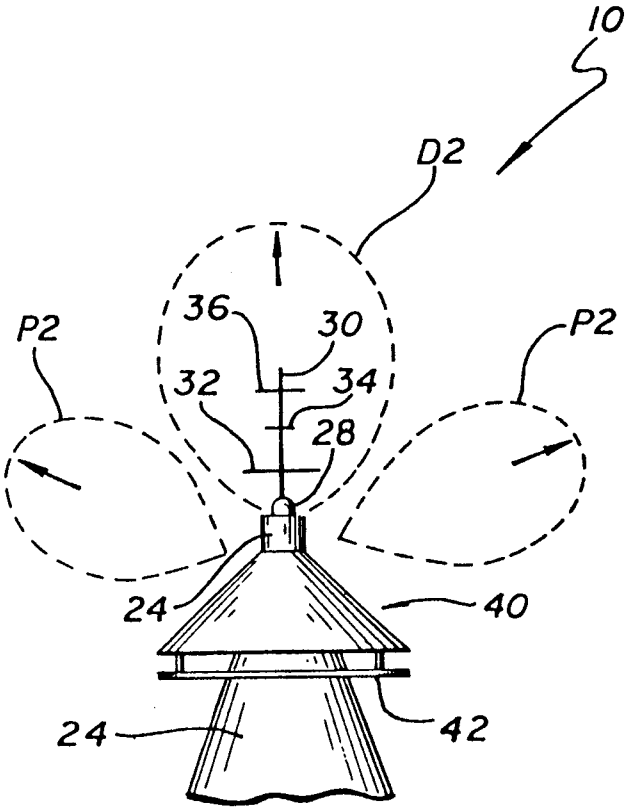
FIG. 4*c* illustratively represents a simplified side view of the antenna of the present invention.
Figure 4B:
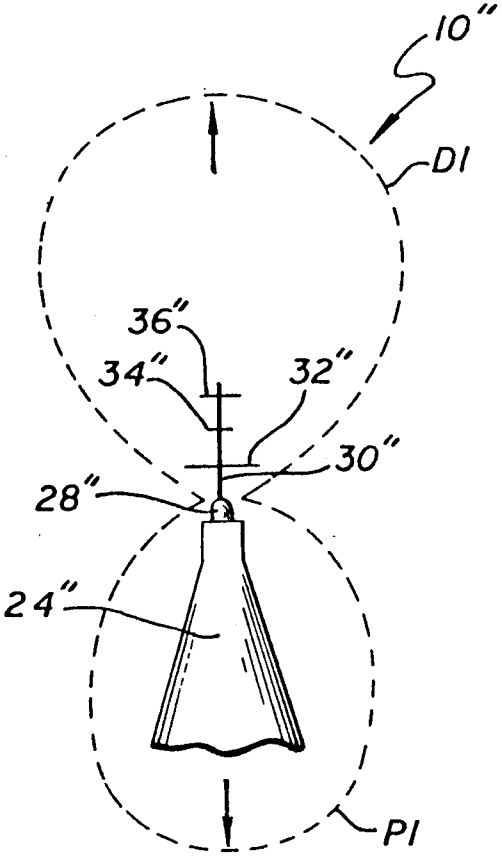
FIG. 4*b* shows a second hypothetical antenna which emits a driven beam D1 and an oppositely directed parasitic beam P1.
Figure 4A:
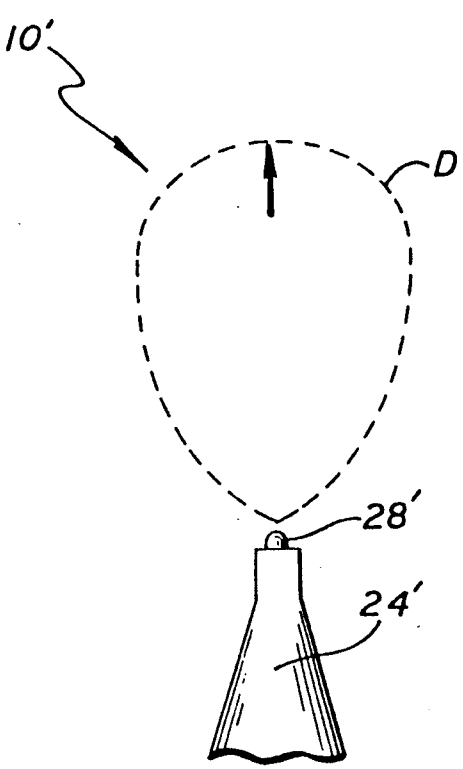
FIG. 4*a* depicts a driven beam D resulting from excitation of a first hypothetical antenna.

FIG. 4*a* depicts a driven beam D resulting from excitation of a first hypothetical antenna. Specifically, the driven beam D represents the radiation pattern resulting from excitation of a first hypothetical antenna 10'. The antenna 10' would be substantially similar to the antenna 10 but for the absence of the mast 30, sets of parasitic elements 32, 34, 36, cone 40 and cone choke 42. The driven beam D emanates from a tapered dielectric rod 28' protruding from a tapered circular waveguide 24'.

FIG. 4*b* shows a second hypothetical antenna 10'' which is equivalent to the antenna 10' except for the addition of a mast 30'' and first, second and third sets of parasitic elements 32'', 34'', and 36''. The dielectric rod 28'' included within the antenna 10'' emits a driven beam D1, which excites the elements 32'', 34'', and 36'' thereby inducing generation of an oppositely directed parasitic beam P1.

Finally, a simplified side view of the inventive antenna 10 is shown in FIG. 4c. It is apparent from FIG. 4c that the cone 40 is operative to redirect a parasitic beam P2 engendered by the first, second and third sets of parasitic elements 32, 34, and 36. In this manner, the inventive antenna 10 projects a radiation pattern having an elevation angle in excess of that provided by conventional telemetry and command antennas.

Turning again to FIG. 1, the efficiency of the antenna 10 may be increased by the inclusion of a conductive waveguide aperture choke 60. The choke 60 is disk-shaped and includes an inner surface conventionally coupled to the outer shell 24 of the tapered waveguide 22. The choke 60 improves efficiency by reducing undesired current flow along the surface of the shell 24. Similarly, the spatial characteristics of the radiation pattern projected by the antenna 10 may be altered by adjusting the relative position on the mast 30 occupied by a conductive matching disk 64. The matching disk 64 is generally affixed to a particular location on the mast 30 after initial antenna radiation pattern measurements are made subsequent to assembly of the antenna 10.

Thus the present invention has been described with reference to a particular embodiment in connection with a particular application. Those having ordinary skill in the art and access to the teachings of the present invention will recognize additional modifications, applications and embodiments within the scope thereof. For example, the teachings of the present invention are not limited to the particular configurations of, or number of members included in, the sets of parasitic elements described herein. Similarly, the scope of the present invention encompasses operative frequency spectra other than the 11.8 to 14.8 GHz spectrum disclosed herein. Further, the present invention is not limited to a forty-five degree slope of the beam shaping cone. Other slopes may be utilized to effectuate specific beam elevation angles.

It is therefore contemplated by the appended claims to cover any and all such modifications.

Accordingly,

What is claimed is:

1. An omnidirectional broad bandwidth antenna, comprising:

input circular waveguide means for providing electromagnetic energy of at least one polarization;

dielectric-loaded waveguide means, coupled to said input circular waveguide means, for projecting a first electromagnetic beam;

parasitic element means, positioned in the path of said first beam, for forming a parasitic beam in response to said first beam;

cone means, coupled to said dielectric-loaded waveguide means, for redirecting said parasitic beam;

wherein said dielectric-loaded waveguide means includes a tapered circular waveguide having first and second ends, said second end defining a waveguide aperture, and a tapered dielectric rod extending through said aperture, said rod having a first segment circumscribed by said circular waveguide and a second segment external thereto; and, wherein said parasitic element means includes:

a conductive mast coupled to said second dielectric rod segment, and a first set of conductive parasitic elements arranged about said mast and coupled thereto.

2. The antenna of claim 1 wherein said first set includes an even number of parasitic elements of equal length, each of said elements being positioned a first distance from said waveguide aperture along said mast.

3. The antenna of claim 2 wherein said parasitic element means further includes second and third sets of parasitic elements arranged symmetrically about said mast, each of said elements in said second set being coupled to said mast a second distance from said waveguide aperture and each of said elements in said third set being coupled to said mast a third distance from said aperture.

4. The antenna of claim 3 further including a conductive matching disk describing a disk aperture which circumscribes said mast, said disk being coupled to said mast between said second and third sets of parasitic elements.

5. The antenna of claim 1 wherein said cone means includes a cone shaped conductor having a first end defining a small aperture and a second end defining a large aperture, said cone being positioned such that said tapered waveguide passes through said large and small apertures with said small aperture of said cone contacting said waveguide at a fourth distance from said waveguide aperture.

6. The antenna of claim 5 further including a conductive waveguide aperture choke disk which circumscribes said circular waveguide, said choke disk being coupled to said tapered waveguide between said waveguide aperture and said cone shaped conductor.

7. The antenna of claim 5 further including a conductive cone choke circumscribing said tapered waveguide and suspended from said second end of said cone.

8. The antenna of claim 1 wherein said input waveguide means includes:

an orthomode tee having first, second and third ports, said first and second ports being disposed to accept linearly polarized electromagnetic energy of first and second polarizations with the relative polarization angle therebetween being substantially equivalent to 90 degrees and a 90 degree dielectric polarizer, coupled to said third port of said orthomode tee, for imparting oppositely directed rotation to said first and second polarizations.

9. In an antenna system having a circular waveguide segment defining a waveguide aperture with a dielectric rod extending therethrough, said system also including a conductive mast coupled to said dielectric rod with a set of parasitic conductive elements coupled to said mast, a method of projecting an omnidirectional radiation pattern comprising the steps of:

a) generating electromagnetic energy of a rotating linear polarization;

b) launching said polarized electromagnetic energy onto said circular waveguide segment thereby inducing said dielectric rod to emit a first electromagnetic beam; and c) forming a parasitic beam in response to said first beam.

10. The method of claim 9 further including the step of redirecting said parasitic beam.

* * * * *